US006977623B2

(12) United States Patent
Durham et al.

(10) Patent No.: US 6,977,623 B2
(45) **Date of Patent: *Dec. 20, 2005**

(54) WIDEBAND SLOTTED PHASED ARRAY ANTENNA AND ASSOCIATED METHODS

(75) Inventors: Timothy E. Durham, Palm Bay, FL (US); Anthony M. Jones, Palm Bay, FL (US); Sean Ortiz, West Melbourne, FL (US); Griffin K. Gothard, Satellite Beach, FL (US)

(73) Assignee: Harris Corporation, Melbourne, FL (US)

( * ) Notice: Subject to any disclaimer, the term of this patent is extended or adjusted under 35 U.S.C. 154(b) by 47 days.

This patent is subject to a terminal disclaimer.

(21) Appl. No.: 10/780,268

(22) Filed: Feb. 17, 2004

(65) Prior Publication Data

US 2005/0179608 A1 Aug. 18, 2005

(51) Int. Cl.[7] ..... H01Q 15/02; H01Q 1/38
(52) U.S. Cl. ..... 343/795; 343/753; 343/797
(58) Field of Search ..... 343/795, 797, 343/802, 813, 814–817, 824, 827, 812

(56) References Cited

U.S. PATENT DOCUMENTS

| | | | | |
|---|---|---|---|---|
| 5,648,786 | A | 7/1997 | Chung et al. | 343/770 |
| 6,417,813 | B1 * | 7/2002 | Durham | 343/753 |
| 6,445,354 | B1 | 9/2002 | Kunysz | 343/770 |
| 6,512,487 | B1 * | 1/2003 | Taylor et al. | 343/795 |
| 6,771,221 | B2 * | 8/2004 | Rawnick et al. | 343/700 MS |
| 6,856,297 | B1 * | 2/2005 | Durham et al. | 343/795 |
| 6,876,336 | B2 * | 4/2005 | Croswell et al. | 343/795 |
| 6,894,655 | B1 * | 5/2005 | Jones et al. | 343/795 |

* cited by examiner

*Primary Examiner*—Thuy V. Tran
*Assistant Examiner*—Hung Tran Vy
(74) *Attorney, Agent, or Firm*—Allen, Dyer, Doppelt, Milbrath & Gilchrist, P.A.

(57) ABSTRACT

A phased array antenna includes a substrate, and a patterned conductive layer is on the substrate. The patterned conductive layer defines a plurality of slotted dipole antenna elements each having a medial feed portion associated therewith. Each slotted dipole antenna element includes a pair of slotted legs extending outwardly from the medial feed portion. Pairs of adjacent slotted legs of adjacent slotted dipole antenna elements include respective spaced apart end portions having predetermined shapes and relative positioning to provide increased inductive coupling between the adjacent slotted dipole antenna elements.

39 Claims, 9 Drawing Sheets

WIDEBAND SLOTTED PHASED ARRAY ANTENNA AND ASSOCIATED METHODS

FIELD OF THE INVENTION

The present invention relates to the field of communications, and more particularly, to slotted phased array antennas.

BACKGROUND OF THE INVENTION

Existing phased array antennas include a wide variety of configurations for various applications, such as satellite reception, remote broadcasting or military communication. The desirable characteristics of low cost, light-weight, low profile and mass producibility are provided in general by printed circuit antennas. The simplest forms of printed circuit antennas are microstrip antennas wherein flat conductive elements are spaced from a single essentially continuous ground element by a dielectric sheet of uniform thickness. An example of a wideband phased array antenna is disclosed in U.S. Pat. No. 6,512,487 to Taylor et al., which is incorporated herein by reference and is assigned to the current assignee of the present invention.

An alternative to microstrip antennas is slotted antennas. A slotted phased array antenna may also be used for communication systems such as identification of friend/foe (IFF) systems, personal communication service (PCS) systems, satellite communication systems and aerospace systems, which require such characteristics as low cost, light weight, low profile and a low sidelobe.

The bandwidth and directivity capabilities of a slotted phased array antenna, however, can be limiting for certain applications. While the use of magnetically coupled slotted antenna elements can increase bandwidth, obtaining this benefit presents significant design challenges, particularly where maintenance of a low profile and broad beamwidth is desirable. Also, the use of slotted antenna elements can improve directivity in a given direction by providing a predetermined scan angle. However, utilizing a slotted phased array antenna presents a dilemma. The scan angle can be increased if the slotted antenna elements are spaced closer together, but closer spacing can increase undesirable coupling between slotted antenna elements, thereby degrading performance.

Increasing the bandwidth of a slotted phased array antenna with a wide scan angle is conventionally achieved by dividing the frequency range into multiple bands. This approach results in a considerable increase in the size and weight of the antenna. For example, U.S. Pat. No. 5,648,786 to Chung et al. discloses a wideband slotted phased array antenna. The antenna in the '786 patent is a periodic slot array antenna comprising a plurality of arrays. The arrays comprise a plurality of conductive cavities adjacent to one another with varying conductive cavity sizes in accordance with a log-periodic scale. The bandwidth of the antenna is extended since several varying size cavities and slots are used, but at the expense of the antenna's overall size and weight.

SUMMARY OF THE INVENTION

In view of the foregoing background, it is therefore an object of the invention to provide a lightweight and compact wideband slotted phased array antenna.

This and other objects, features and advantages in accordance with the present invention are provided by a wideband slotted phased array antenna comprising a substrate, and a patterned conductive layer on the substrate. The patterned conductive layer may define a plurality of slotted dipole antenna elements each having a medial feed portion associated therewith. Each slotted dipole antenna element may comprise a pair of slotted legs extending outwardly from the medial feed portion. Pairs of adjacent slotted legs of adjacent slotted dipole antenna elements may include respective spaced apart end portions having predetermined shapes and relative positioning to provide increased inductive coupling between the adjacent slotted dipole antenna elements.

The spaced apart end portions in adjacent slotted legs may comprise interdigitated portions, and each slotted leg may comprises an elongated slotted body portion, an enlarged slotted width end portion connected to an end of the elongated slotted body portion, and a plurality of slotted fingers (the interdigitated portions), e.g., four, extending outwardly from the enlarged slotted width end portion.

The wideband slotted phased array antenna has a desired frequency range and the spacing between the end portions of adjacent slotted legs is less than about one-half a wavelength of a highest desired frequency. Also, the plurality of slotted dipole antenna elements may include first and second sets of orthogonal slotted dipole antenna elements to provide dual polarization. A ground plane is preferably provided adjacent the patterned conductive layer and is spaced from the plurality of slotted dipole antenna elements less than about one-half a wavelength of a highest desired frequency.

The plurality of slotted dipole antenna elements may be arranged at a density in a range of about 100 to 900 per square foot. The plurality of slotted dipole antenna elements are sized and relatively positioned so that the wideband slotted phased array antenna is operable over a frequency range of about 2 to 30 GHz, and at a scan angle of about ±60 degrees. There may be at least one dielectric layer adjacent the plurality of slotted dipole antenna elements. In addition, the substrate may be flexible so that it may be supported on a rigid mounting member having a non-planar three-dimensional shape.

The phased array antenna may further comprises a respective impedance element electrically connected to the patterned conductive layer between the spaced apart end portions of adjacent slotted legs of adjacent slotted dipole antenna elements for further increasing the inductive coupling therebetween. Alternatively, the phased array antenna may further comprise a respective printed impedance element adjacent the spaced apart end portions of adjacent slotted legs of adjacent slotted dipole antenna elements for further increasing the inductive coupling therebetween.

Another aspect of the present invention is directed to a method for making a phased array antenna comprising providing a patterned conductive layer, and defining a plurality of slotted dipole antenna elements in the patterned conductive layer. Each slotted dipole antenna element may have a medial feed portion associated therewith, and comprising a pair of slotted legs extending outwardly from the medial feed portion. Defining the plurality of slotted dipole antenna elements includes shaping and positioning respective spaced apart end portions of adjacent slotted legs of adjacent slotted dipole antenna elements to provide increased inductive coupling between the adjacent slotted dipole antenna elements.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime, double prime and triple prime notations are used to indicate similar elements in alternative embodiments.

Figure 1:
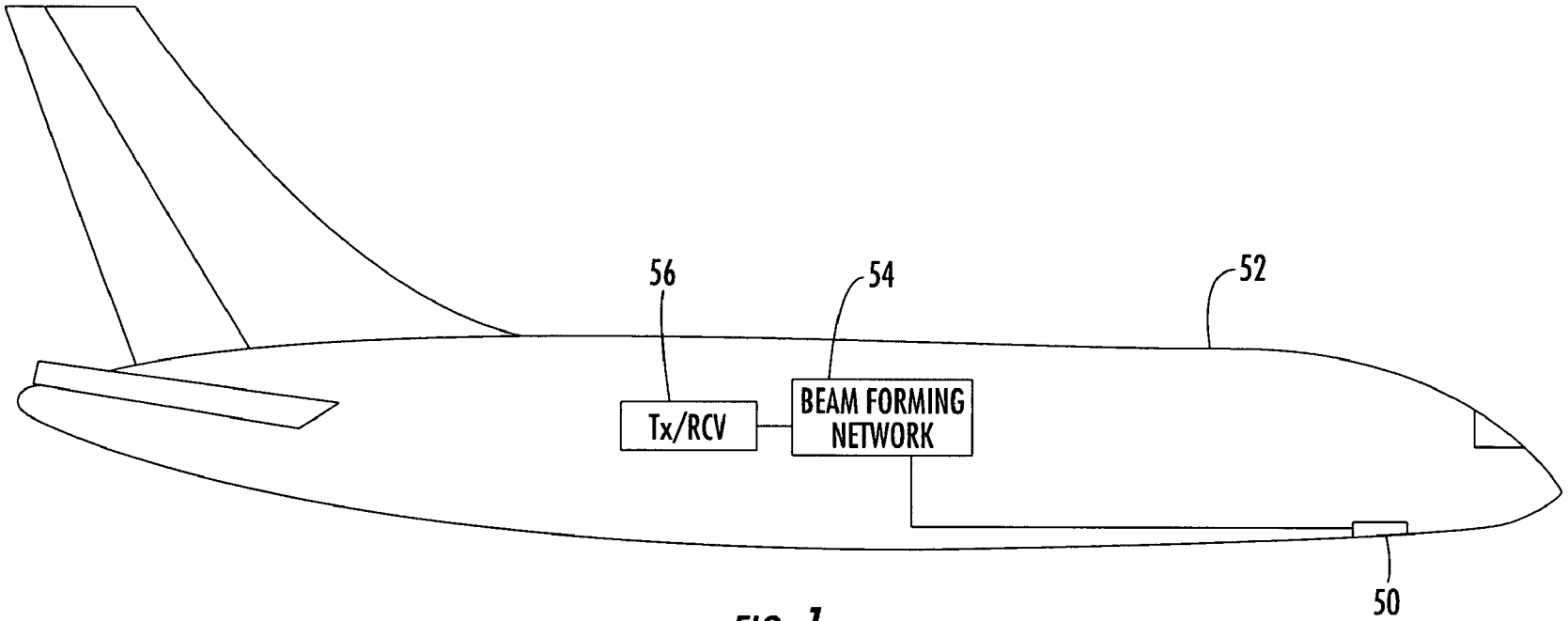
FIG. 1 is a schematic diagram illustrating a wideband slotted phased array antenna mounted on an aircraft in accordance with the present invention.
Figure 2:
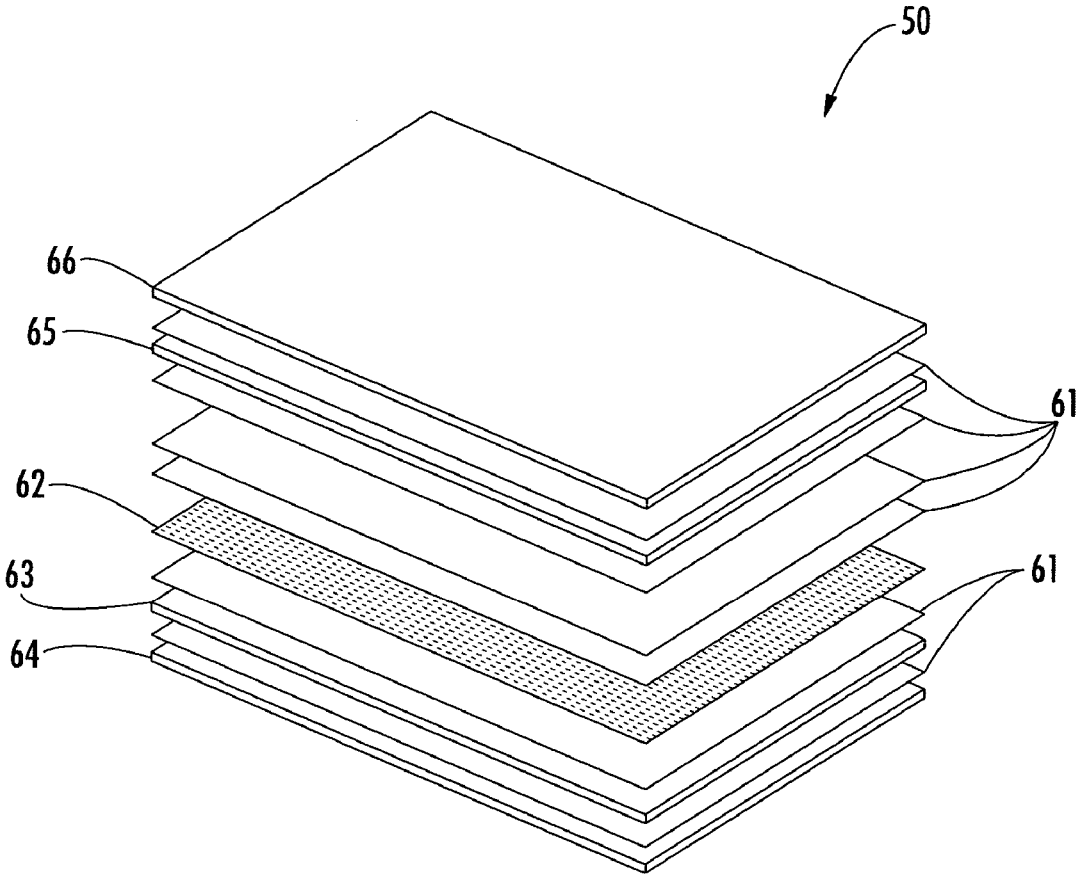
FIG. 2 is an exploded view of the wideband slotted phased array antenna of FIG. 1.

Referring initially to FIGS. 1 and 2, a wideband slotted phased array antenna 50 in accordance with the present invention will now be described. One or more wideband slotted phased array antennas 50 may be mounted on an aircraft 52, for example. The illustrated wideband slotted phased array antenna 50 is connected to a beam forming network (BFN) 54 which is connected to a transceiver 56. The BFN 54 controls the phase of the wideband slotted phased array antenna 50 to create the desired sum and difference patterns, which forms the desired antenna beams, as readily understood by those skilled in the art. An example BFN 54 is a Butler matrix.

The wideband slotted phased array antenna 50 is preferably formed of a plurality of flexible layers as shown in FIG. 2. These layers include a patterned conductive layer 62 sandwiched between a ground plane 64 and a cap layer 66. Additionally, inner and outer dielectric layers of foam 63, 65 are provided. Respective adhesive layers 61 secure the patterned conductive layer 62, ground plane 64, cap layer 66, and inner and outer dielectric layers of foam 63, 65 together to form the wideband slotted phased array antenna 50, which is flexible and conformal.

Figure 3A:
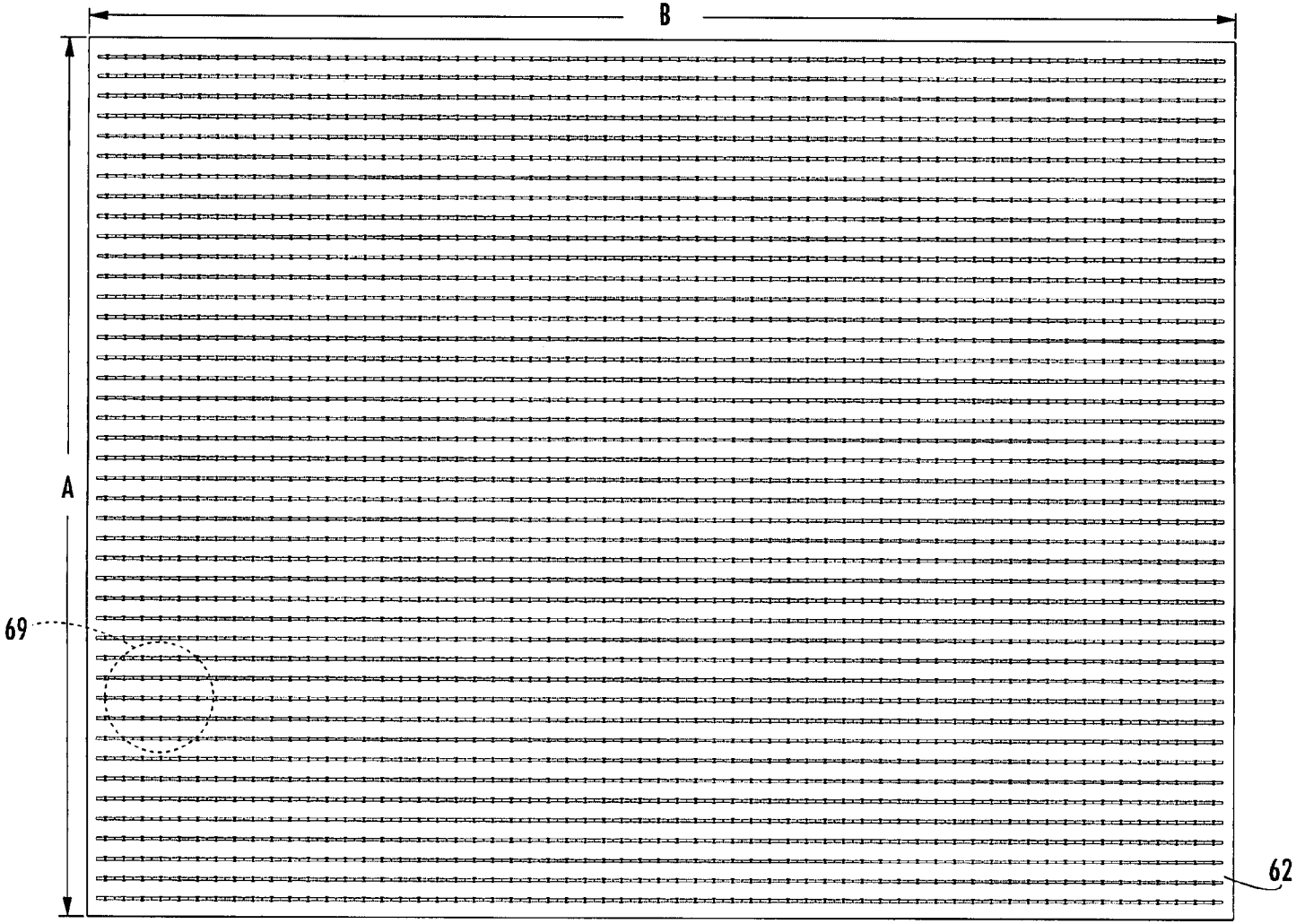
FIG. 3A is a schematic diagram of the patterned conductive layer of the wideband slotted phased array antenna in accordance with the present invention.
Figure 3B:
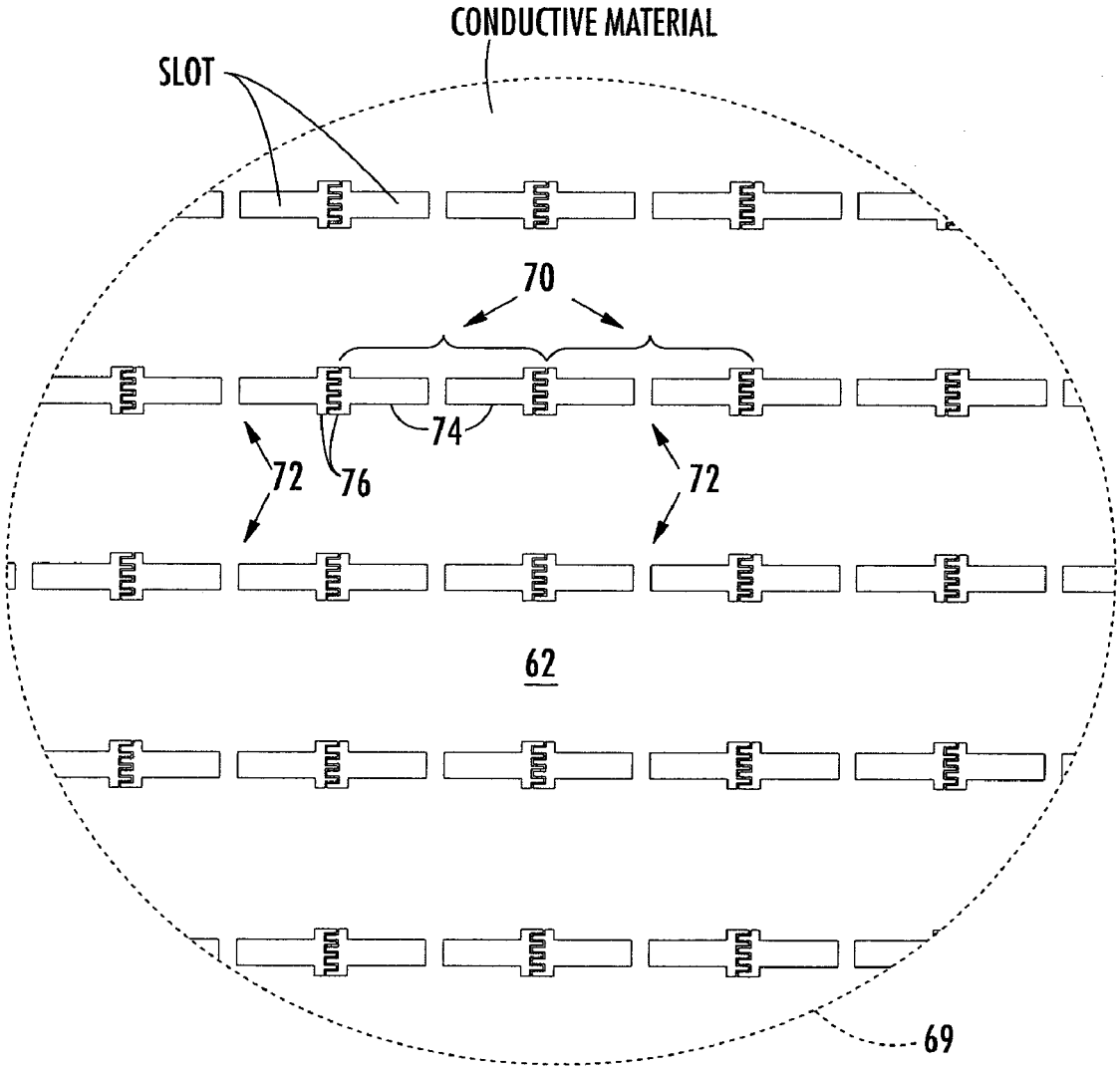
FIG. 3B is a greatly enlarged view of a portion of the patterned conductive layer as shown in FIG. 3A.

Referring now to FIGS. 3A and 3B, the patterned conductive layer 62 of the slotted phased array antenna 50 will now be discussed in greater detail. The patterned conductive layer 62 defines a plurality of slotted dipole antenna elements 70 each having a medial feed portion 72 associated therewith, as best shown in the greatly enlarged view of portion 69 (FIG. 3B) from the patterned conductive layer illustrated in FIG. 3A.

In other words, the patterned conductive layer 62 is a conductive material, and the slotted dipole antenna elements 70 are slots formed within the conductive material. The wideband slotted phased array antenna 50 in accordance with the present invention is an inverse of the wideband phased array antenna disclosed in U.S. Pat. No. 6,512,487 to Taylor et al. as discussed above in the background section herein. In the '487 patent the conductive material forming the dipole antenna elements has been replaced with a slot or hole, and the open areas adjacent the dipole antenna elements are now a conductive material. Respective feed lines are connected to the medial feed portions 72 from the opposite side of the patterned conductive layer 62.

Each slotted dipole antenna element 70 comprises a pair of slotted legs 74 extending outwardly from the medial feed portion 72. Pairs of adjacent slotted legs of adjacent slotted dipole antenna elements 70 include respective spaced apart end portions 76 having predetermined shapes and relative positioning to provide increased inductive coupling between the adjacent slotted dipole antenna elements. The spacing between the end portions 76 of adjacent legs 74 is less than about one-half a wavelength of a highest desired frequency.

The illustrated wideband slotted phased array antenna 50, in terms of the patterned conductive layer 62, may have the following dimensions: a width A of 12 inches and a height B of 18 inches. In this example, the number of slotted dipole antenna elements 70 along the width A equals 43, and the number of slotted dipole antenna elements along the length B equals 65, resulting in an array of 2,795 slotted dipole antenna elements. Of course the actual size of the wideband slotted phased array antenna 50 may vary depending on the intended application. The wideband slotted phased array antenna 50 has a desired frequency range from 2 GHz to 30 GHz, for example.

Figure 4A:
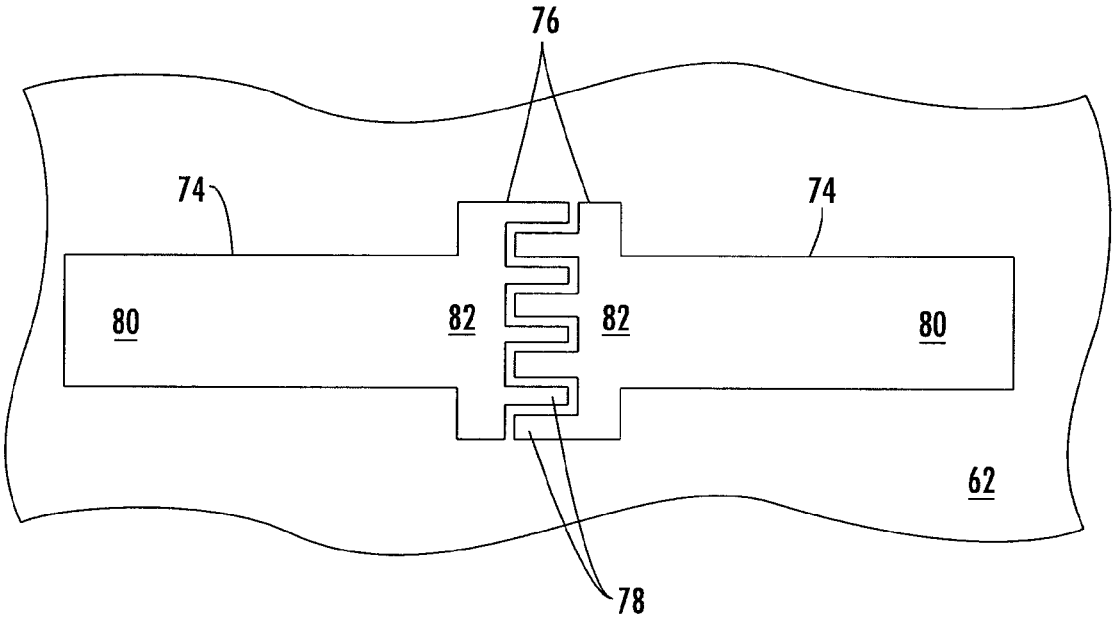
FIG. 4A is an enlarged schematic view of the spaced apart end portions of adjacent slotted legs of adjacent slotted dipole antenna elements of the wideband slotted phased array antenna as shown in FIG. 2.

As shown in FIG. 4A, the spaced apart end portions 76 in adjacent legs 74 have slotted overlapping or interdigitated portions 78. Each slotted leg 74 comprises an elongated slotted body portion 80, an enlarged slotted width end portion 82 connected to an end of the elongated slotted body portion, and a plurality of slotted fingers (i.e., the interdigitated portions 78), e.g., four, extending outwardly from the enlarged width end portion.

Figure 4B:
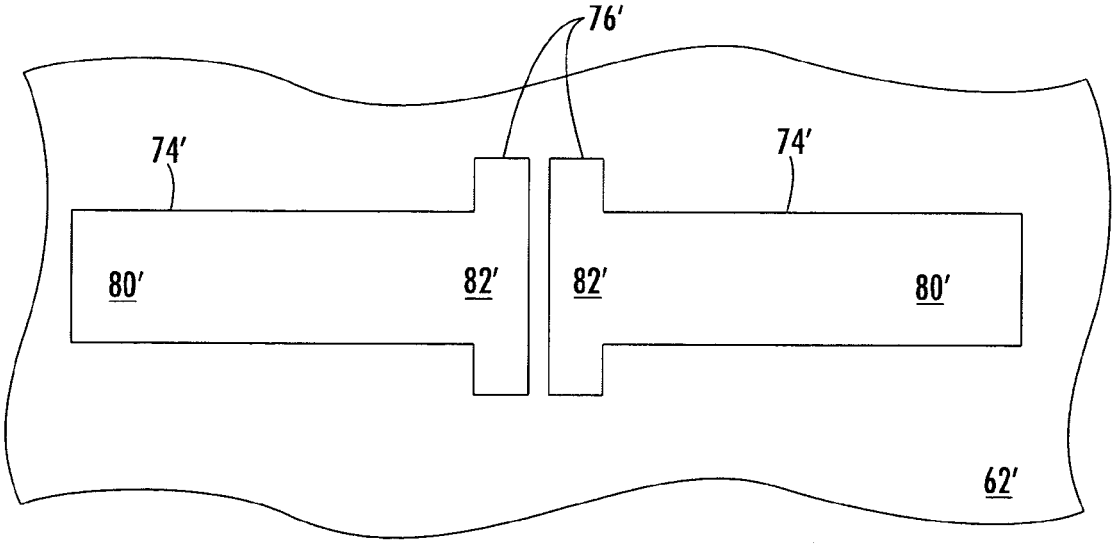
FIG. 4B is an enlarged schematic view of another embodiment of the adjacent slotted legs of adjacent slotted dipole antenna elements in accordance with the present invention.

Alternatively, as shown in FIG. 4B, adjacent slotted legs 74' of adjacent slotted dipole antenna elements 70 may have respective spaced apart end portions 76' to provide increased inductive coupling between the slotted adjacent dipole antenna elements. In this embodiment, the spaced apart end portions 76' in adjacent legs 74' comprise enlarged width end portions 82' connected to an end of the elongated body portion 80' to provide the increased inductive coupling between the adjacent slotted dipole antenna elements.

The plurality of slotted dipole antenna elements 70 may be arranged at a density in a range of about 100 to 900 per square foot. The plurality of slotted dipole antenna elements 70 are sized and relatively positioned so that the wideband slotted phased array antenna 50 is operable over a frequency range of about 2 GHz to 30 GHz, and at a scan angle of about ±60 degrees (low scan loss). Such an antenna 50 may also have a 10:1 or greater bandwidth, includes conformal surface mounting, while being relatively lightweight, and easy to manufacture at a low cost.

Figure 5A:
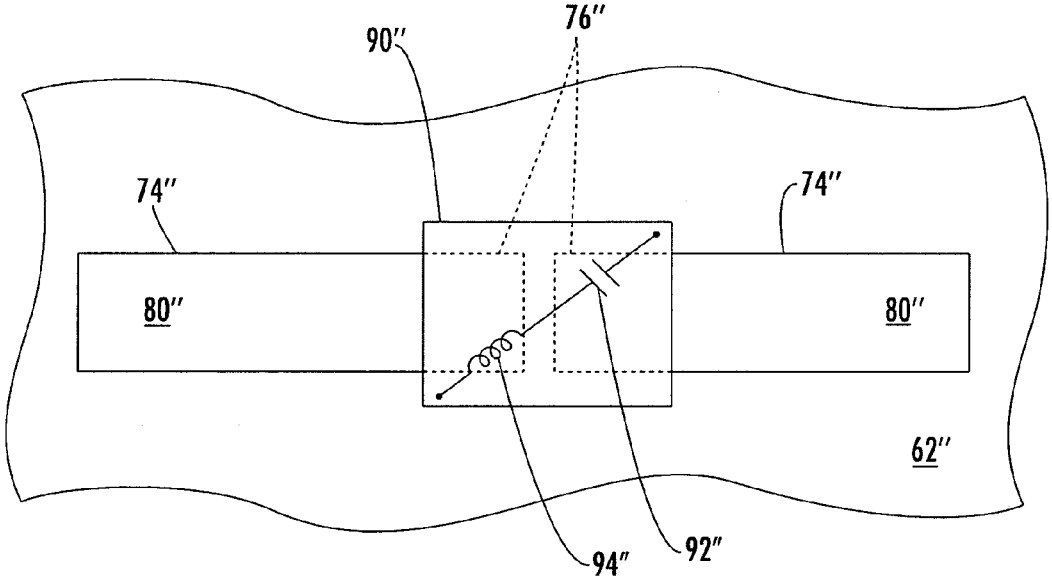
FIG. 5A is an enlarged schematic view of an impedance element connected to the patterned conductive layer between the spaced apart end portions of adjacent slotted legs of adjacent slotted dipole antenna elements as may be used in the wideband slotted phased array antenna as shown in FIG. 2.
Figure 5B:
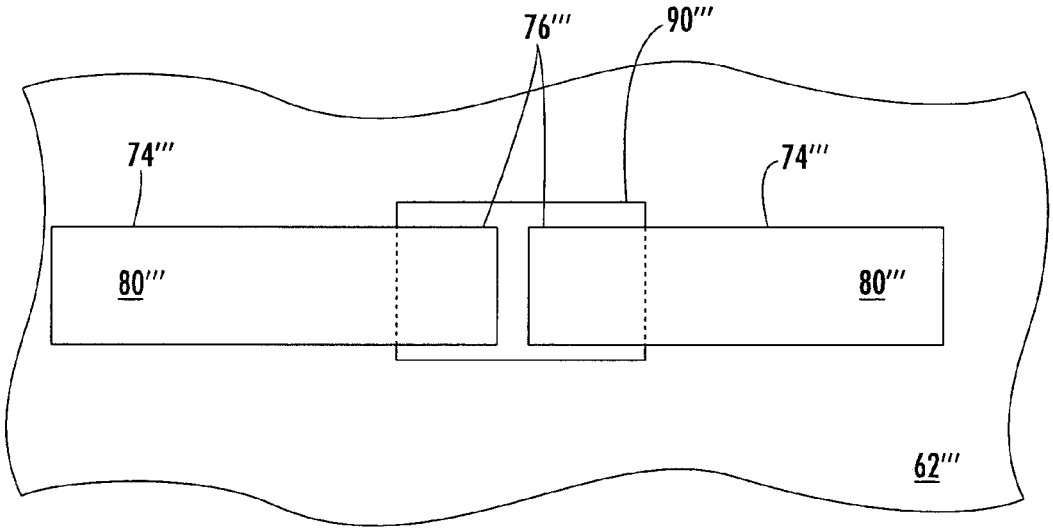
FIG. 5B is an enlarged schematic view of another embodiment of an impedance element adjacent the spaced apart end portions of adjacent slotted legs of adjacent slotted dipole antenna elements as may be used in the wideband slotted phased array antenna as shown in FIG. 2.

To further increase the inductive coupling between adjacent slotted dipole antenna elements 70, a respective discrete or bulk impedance element 90" is electrically connected to the patterned conductive layer 62" between the spaced apart end portions 76" of adjacent slotted legs 74" of adjacent slotted dipole antenna elements, as illustrated in FIG. 5A.

In the illustrated embodiment, the spaced apart end portions 76" have the same width as the elongated body portions 80". The discrete impedance elements 90" are preferably soldered in place after the slotted dipole antenna elements have been formed so that they transversly overlay the respective adjacent slotted legs 74" of adjacent slotted dipole antenna elements. This advantageously allows the same inductance to be provided in a smaller area, which helps to lower the operating frequency of the wideband slotted phased array antenna 50 or provide improved bandwidth performance.

The illustrated discrete impedance element 90" includes a capacitor 92" and an inductor 94" connected together in series. However, other configurations of the capacitor 92" and inductor 94" are possible, as would be readily appreciated by those skilled in the art. For example, the capacitor 92" and inductor 94" may be connected together in parallel, or the discrete impedance element 90" may include the inductor 94" without the inductor or the capacitor 92" without the inductor. Depending on the intended application, the discrete impedance element 90" may even include a resistor.

The discrete impedance element 90" may also be connected between the adjacent legs 74 with the overlapping or interdigitated portions 78 illustrated in FIG. 4A. Likewise, the discrete impedance element 90" may also be connected between the adjacent legs 74' with the enlarged width end portions 82' illustrated in FIG. 4B.

Another advantage of the respective discrete impedance elements 90" is that they may have different impedance values so that the bandwidth of the plurality of slotted dipole antenna elements 70 can be tuned for different applications, as would be readily appreciated by those skilled in the art. In addition, the impedance is not dependent on the electrical properties of the adjacent dielectric layer 63, 65. Since the discrete impedance elements 90" are not effected by the dielectric layers 63, 65, this approach advantageously allows the impedance between the dielectric layers 62, 65 and the impedance of the discrete impedance element 90" to be decoupled from one another.

Figure 6A:
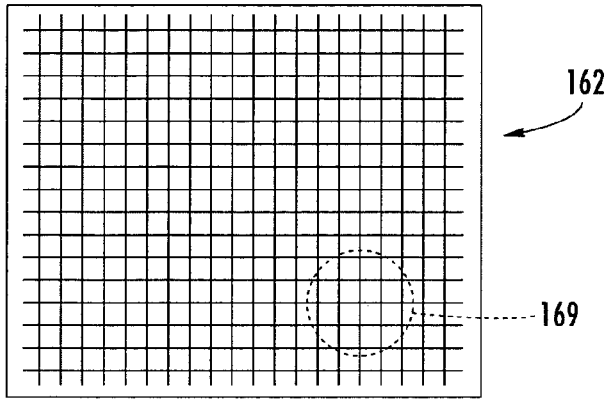
FIG. 6A is a schematic diagram of another embodiment of the patterned conductive layer of the wideband slotted phased array antenna in accordance with the present invention.
Figure 6B:
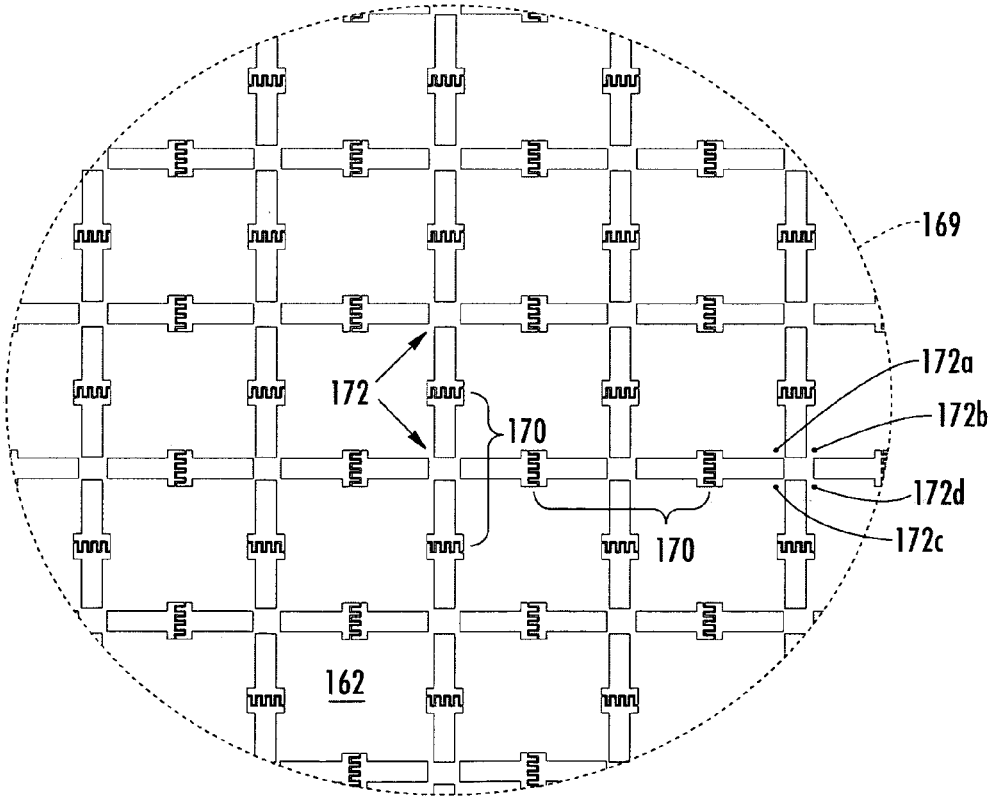
FIG. 6B is a greatly enlarged view of a portion of the patterned conductive layer as shown in FIG. 6B.

Referring now to FIGS. 6A and 6B, another embodiment of the patterned conductive layer 162 includes first and second sets of slotted dipole antenna elements 170 which are orthogonal to each other to provide dual polarization, as would be readily appreciated by those skilled in the art. The first and second sets of slotted dipole antenna elements 170 are shown in greater detail in the enlarged view (FIG. 6B) of a portion 169 of the patterned conductive layer 162 illustrated in FIG. 6A.

Figure 7:
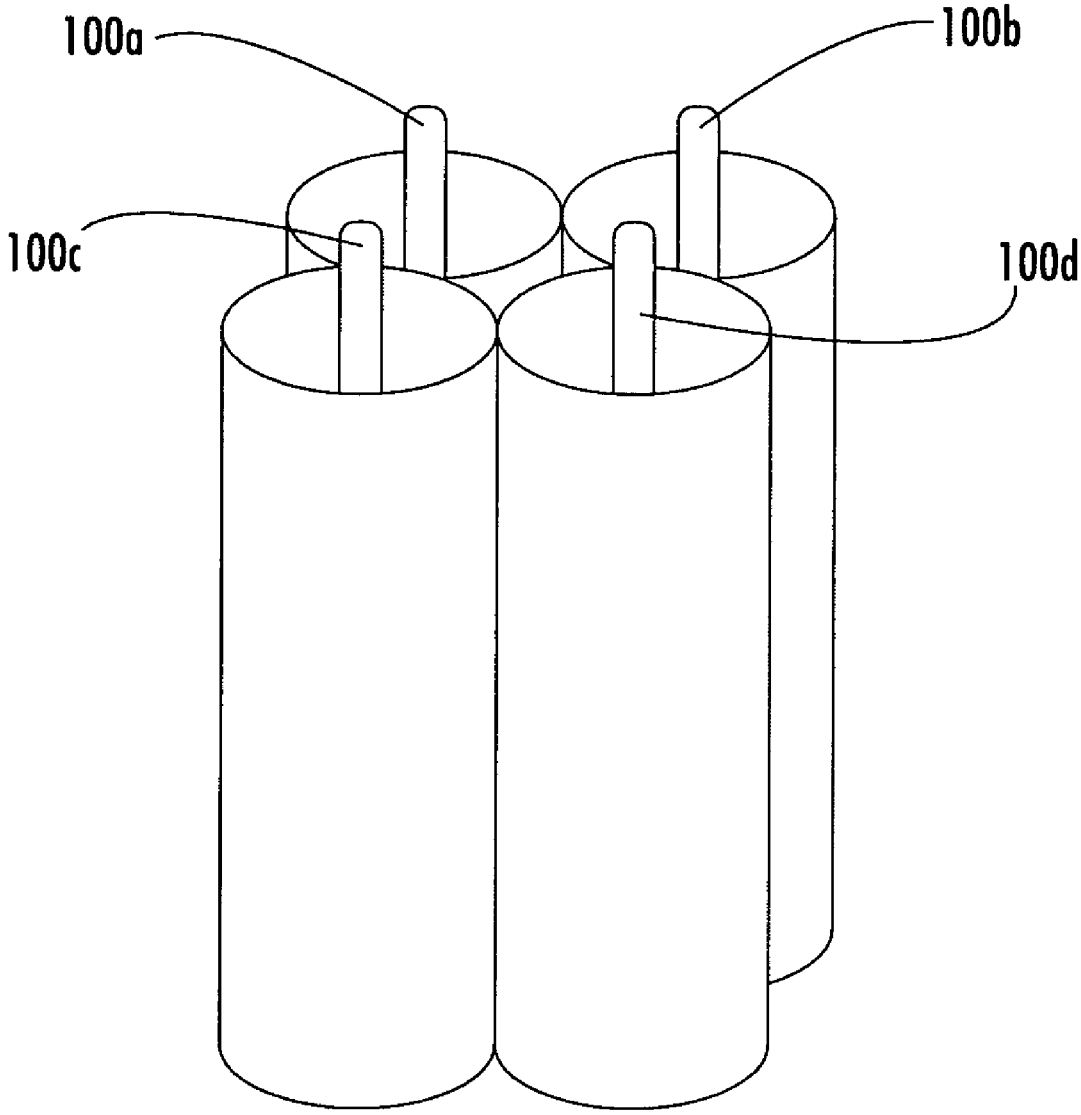
FIG. 7 is a schematic diagram of feed lines to be connected to the slotted dipole antenna elements illustrated in FIGS. 6A and 6B.

Respective feed lines 100 (as illustrated in FIG. 7) are connected to the feed portions 172 from the opposite side of the patterned conductive layer 60. For the first and second sets of slotted dipole antenna elements 170 which are orthogonal, feed lines 100*a*, 100*b* 100*c* and 100*d* are respectively connected to the feed portions 172*a*, 172*b* 172*c* and 172*d* on the patterned conductive layer 162.

Figure 8:
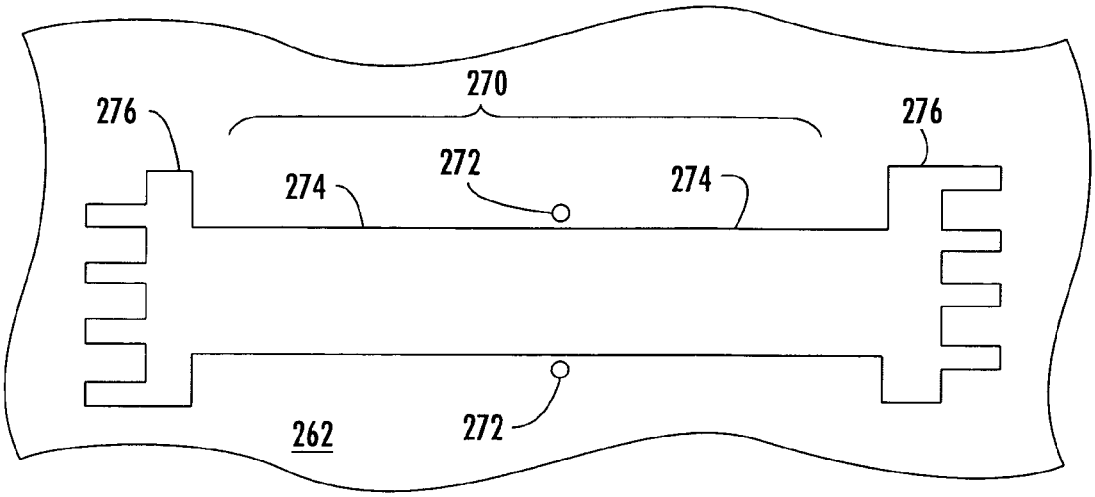
FIGS. 8 and 9 are enlarged schematic views of alternative embodiments of the slotted dipole antenna elements in accordance with the present invention.
Figure 9:
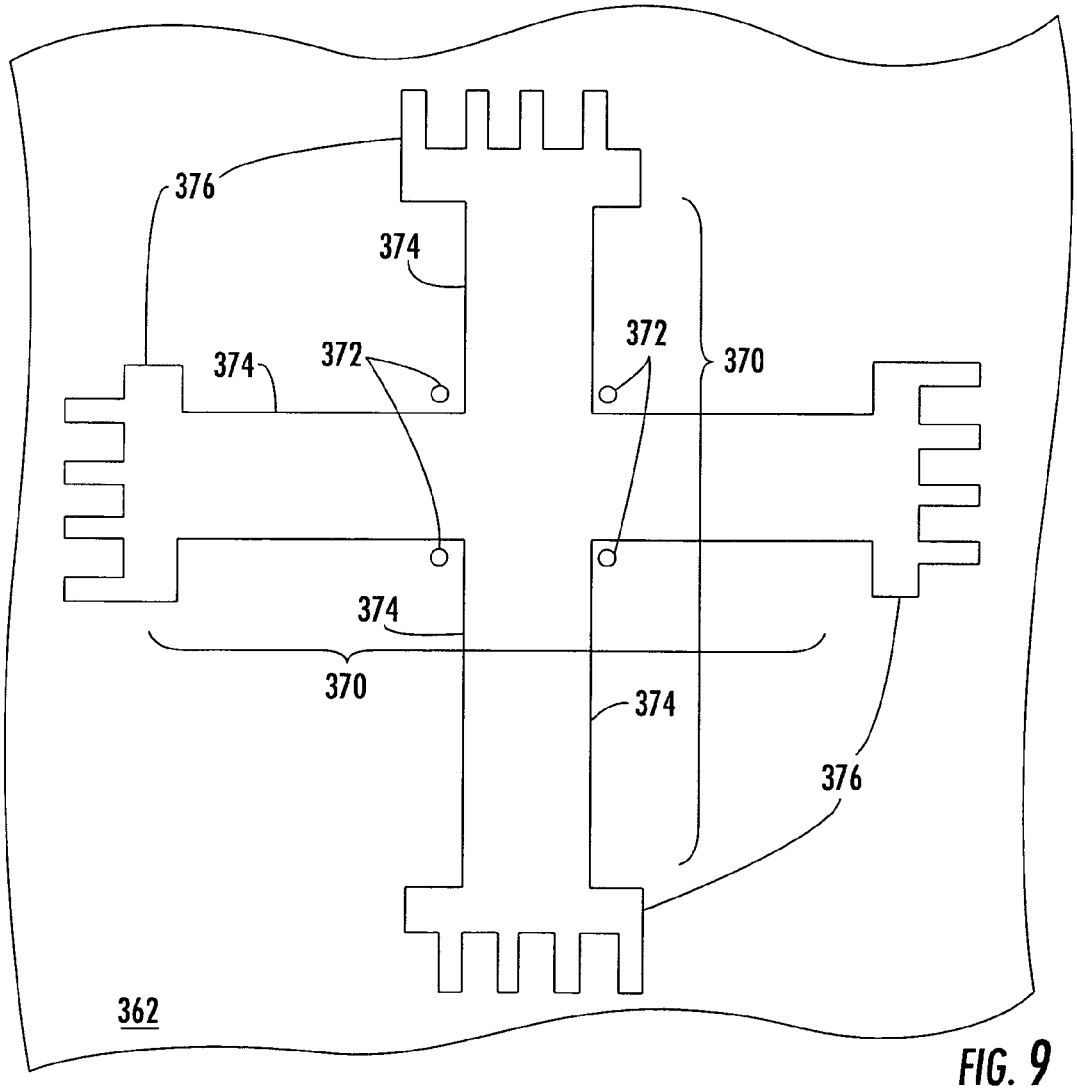

An alternative embodiment of the slotted dipole antenna elements will now be discussed with reference to FIGS. 8 and 9. As discussed above, each slotted dipole antenna element 270 (single polarization) and 370 (dual polarization) comprises a pair of slotted legs 274, 374 extending outwardly from the medial feed portions 272, 372. In particular, the legs 274, 374 of each pair of slotted legs are coupled at the medial feed portions 272, 372 to define a continuous slot. The medial feed portions 272, 372 are now adjacent each slotted dipole antenna element as readily appreciated by those skilled in the art. Respective feed lines are connected to the medial feed portions 272, 372 from the opposite side of the patterned conductive layer 262, 362.

Nonetheless, pairs of adjacent slotted legs of adjacent slotted dipole antenna elements 270, 370 include respective spaced apart end portions 276, 376 having predetermined shapes and relative positioning to provide increased inductive coupling between the adjacent slotted dipole antenna elements. Even though the illustrated slotted dipole antenna elements 270, 370 include interdigitated portions, any of the embodiments discussed above are also applicable. Moreover, a coaxial line center conductor may be connected across the respective medial feed portions 272, 372 for each slotted dipole antenna element 270, 370.

Another aspect of the present invention is directed to a method for making a phased array antenna providing a patterned conductive layer, and defining a plurality of slotted dipole antenna elements in the patterned conductive layer. Each slotted dipole antenna element may have a medial feed portion associated therewith, and comprising a pair of slotted legs extending outwardly from the medial feed portion. Defining the plurality of slotted dipole antenna elements includes shaping and positioning respective spaced apart end portions of adjacent slotted legs of adjacent slotted dipole antenna elements to provide increased inductive coupling between the adjacent slotted dipole antenna elements.

Many modifications and other embodiments of the invention will come to the mind of one skilled in the art having the benefit of the teachings presented in the foregoing descriptions and the associated drawings. For example, the slotted phased array antenna may have other configurations, such as those disclosed in the following pending applications: PHASED ARRAY ANTENNA WITH SELECTIVE CAPACITIVE COUPLING AND ASSOCIATED METHODS, attorney docket number GCSD-1493 (51349); MULTIBAND CONCENTRICALLY DISTRIBUTED PHASED ARRAY ANTENNA AND ASSOCIATED METHODS, attorney docket number GCSD-1488 (51350); MULTIBAND RADIALLY DISTRIBUTED GRADED PHASED ARRAY ANTENNA AND ASSOCIATED METHODS, attorney docket number GCSD-1487 (51351); MULTIBAND RADIALLY DISTRIBUTED PHASED ARRAY ANTENNA WITH A SLOPPING GROUND PLANE AND ASSOCIATED METHODS, attorney docket number GCSD-1486 (51352); and MULTIBAND RADIALLY DISTRIBUTED PHASED ARRAY ANTENNA WITH A PLATEAU SHAPED GROUND PLANE AND ASSOCIATED METHODS, attorney docket number GCSD-1485 (51353). These pending applications are incorporated herein by reference and are assigned to the current assignee of the present invention. Therefore, it is understood that the invention is not to be limited to the specific embodiments disclosed, and that modifications and embodiments are intended to be included within the scope of the appended claims.

What is claimed is:

1. A phased array antenna comprising:

a substrate; and a patterned conductive layer on said substrate and defining a plurality of slotted dipole antenna elements each having a medial feed portion associated therewith, each slotted dipole antenna element comprising a pair of slotted legs extending outwardly from the medial feed portion, pairs of adjacent slotted legs of adjacent slotted dipole antenna elements including respective spaced apart end portions having predetermined shapes and relative positioning to provide increased inductive coupling between the adjacent slotted dipole antenna elements.

2. A phased array antenna according to claim 1 wherein the legs of a pair thereof are coupled at the medial feed portion to define a continuous slot.

3. A phased array antenna according to claim 1 wherein each slotted leg includes an elongated slotted body portion, and an enlarged slotted width end portion at an end of the elongated slotted body portion.

4. A phased array antenna according to claim 1 wherein the spaced apart end portions in adjacent slotted legs include interdigitated portions.

5. A phased array antenna according to claim 4 wherein each slotted leg includes an elongated slotted body portion, an enlarged slotted width end portion connected at an end of the elongated slotted body portion, and a plurality of slotted fingers extending outwardly from the enlarged slotted width end portion.

6. A phased array antenna according to claim 1 wherein the phased array antenna has a desired frequency range; and wherein the spacing between the end portions of adjacent slotted legs is less than about one-half a wavelength of a highest desired frequency.

7. A phased array antenna according to claim 1 wherein said plurality of slotted dipole antenna elements comprise first and second sets of orthogonal slotted dipole antenna elements to provide dual polarization.

8. A phased array antenna according to claim 1 further comprising a ground plane adjacent said plurality of slotted dipole antenna elements.

9. A phased array antenna according to claim 8 wherein the phased array antenna has a desired frequency range; and wherein said ground plane is spaced from said plurality of slotted dipole antenna elements less than about one-half a wavelength of a highest desired frequency.

10. A phased array antenna according to claim 1 wherein said plurality of slotted dipole antenna elements are arranged at a density in a range of about 100 to 900 per square foot.

11. A phased array antenna according to claim 1 wherein said plurality of slotted dipole antenna elements are sized and relatively positioned so that the phased array antenna is operable over a frequency range of about 2 to 30 GHz.

12. A phased array antenna according to claim 1 wherein said plurality of slotted dipole antenna elements are sized and relatively positioned so that the phased array antenna is operable over a scan angle of about ±60 degrees.

13. A phased array antenna according to claim 1 further comprising at least one dielectric layer adjacent said patterned conductive layer.

14. A phased array antenna according to claim 1 further comprising a respective impedance element electrically connected to said patterned conductive layer between the spaced apart end portions of adjacent slotted legs of adjacent slotted dipole antenna elements to further increase the inductive coupling therebetween.

15. A phased array antenna according to claim 1 further comprising a respective printed impedance element adjacent the spaced apart end portions of adjacent slotted legs of adjacent slotted dipole antenna elements to further increase the inductive coupling therebetween.

16. A phased array antenna comprising:

a patterned conductive layer defining an array of slotted dipole antenna elements each having a medial feed portion associated therewith, each slotted dipole antenna element comprising a pair of slotted legs extending outwardly from the medial feed portion, and pairs of adjacent slotted legs of adjacent slotted dipole antenna elements including respective spaced apart end portions having predetermined shapes and relative positioning to provide increased inductive coupling between the adjacent slotted dipole antenna elements; and a ground plane adjacent said plurality of slotted dipole antenna elements.

17. A phased array antenna according to claim 16 wherein the legs of a pair thereof are coupled at the medial feed portion to define a continuous slot.

18. A phased array antenna according to claim 16 wherein each slotted leg includes an elongated slotted body portion, and an enlarged slotted width end portion at an end of the elongated slotted body portion.

19. A phased array antenna according to claim 16 wherein each slotted leg includes an elongated slotted body portion, an enlarged slotted width end portion connected at an end of the elongated slotted body portion, and a plurality of slotted fingers extending outwardly from the enlarged slotted width end portion.

20. A phased array antenna according to claim 16 wherein the phased array-antenna has a desired frequency range; and wherein the spacing between the end portions of adjacent slotted legs is less than about one-half a wavelength of a highest desired frequency.

21. A phased array antenna according to claim 16 wherein said plurality of slotted dipole antenna elements comprise first and second sets of orthogonal slotted dipole antenna elements to provide dual polarization.

22. A phased array antenna according to claim 16 wherein the phased array antenna has a desired frequency range; and wherein said ground plane is spaced from said plurality of slotted dipole antenna elements less than about one-half a wavelength of a highest desired frequency.

23. A phased array antenna according to claim 16 wherein said plurality of slotted dipole antenna elements are arranged at a density in a range of about 100 to 900 per square foot.

24. A phased array antenna according to claim 16 wherein said plurality of slotted dipole antenna elements are sized and relatively positioned so that the phased array antenna is operable over a frequency range of about 2 to 30 GHz.

25. A phased array antenna according to claim 16 further comprising at least one dielectric layer adjacent said patterned conductive layer.

26. A phased array antenna according to claim 16 further comprising a respective impedance element electrically connected to said patterned conductive layer between the spaced apart end portions of adjacent slotted legs of adjacent slotted dipole antenna elements to further increase the inductive coupling therebetween.

27. A phased array antenna according to claim 16 further comprising a respective printed impedance element adjacent the spaced apart end portions of adjacent slotted legs of adjacent slotted dipole antenna elements to further increase the inductive coupling therebetween.

28. A method for making a phased array antenna comprising:

providing a patterned conductive layer; and defining a plurality of slotted dipole antenna elements in the patterned conductive layer, each slotted dipole antenna element having a medial feed portion associated therewith and comprising a pair of slotted legs extending outwardly from the medial feed portion, and defining the plurality of slotted dipole antenna elements includes shaping and positioning respective spaced apart end portions of adjacent slotted legs of adjacent slotted dipole antenna elements to provide increased inductive coupling between the adjacent slotted dipole antenna elements.

29. A method according to claim 28 wherein the legs of a pair thereof are coupled at the medial feed portion to define a continuous slot.

30. A method according to claim 28 wherein each slotted leg includes an elongated slotted body portion, and an enlarged slotted width end portion at an end of the elongated slotted body portion.

31. A method according to claim 28 wherein each slotted leg includes an elongated slotted body portion, an enlarged slotted width end portion connected at an end of the elongated slotted body portion, and a plurality of slotted fingers extending outwardly from the enlarged slotted width end portion.

32. A method according to claim 28 wherein the phased array antenna has a desired frequency range; and wherein the spacing between the end portions of adjacent slotted legs is less than about one-half a wavelength of a highest desired frequency.

33. A method according to claim 28 wherein defining the plurality of slotted dipole antenna elements comprise defining first and second sets of orthogonal slotted dipole antenna elements to provide dual polarization.

34. A method according to claim 28 wherein the phased array antenna has a desired frequency range; and further comprising forming a ground plane spaced from the plurality of slotted dipole antenna elements less than about one-half a wavelength of a highest desired frequency.

35. A method according to claim 28 wherein the plurality of slotted dipole antenna elements are arranged at a density in a range of about 100 to 900 per square foot.

36. A method according to claim 28 wherein the plurality of slotted dipole antenna elements are sized and relatively positioned so that the phased array antenna is operable over a frequency range of about 2 to 30 GHz.

37. A method according to claim 28 further comprising forming at least one dielectric layer adjacent the patterned conductive layer.

38. A method according to claim 28 further comprising electrically connecting a respective impedance element to the patterned conductive layer between the spaced apart end portions of adjacent slotted legs of adjacent slotted dipole antenna elements to further increase the inductive coupling therebetween.

39. A method according to claim 28 further comprising forming a respective printed impedance element adjacent the spaced apart end portions of adjacent slotted legs of adjacent slotted dipole antenna elements to further increase the inductive coupling therebetween.

* * * * *

UNITED STATES PATENT AND TRADEMARK OFFICE

CERTIFICATE OF CORRECTION

PATENT NO. : 6,977,623 B2
APPLICATION NO. : 10/780268
DATED : December 20, 2005
INVENTOR(S) : Durham et al.

It is certified that error appears in the above-identified patent and that said Letters Patent is hereby corrected as shown below:

| | |
|---|---|
| Column 2, Line 15 | Delete: "comprises"<br>Insert: --comprise-- |
| Column 2, Line 44 | Delete: "comprises"<br>Insert: --comprise-- |
| Column 5, Line 40 | Delete: "the inductor or"<br>Insert: --the capacitor or-- |

Signed and Sealed this

First Day of August, 2006

JON W. DUDAS
*Director of the United States Patent and Trademark Office*